United States Patent [19]

Chavannes et al.

[11] 4,264,324

[45] Apr. 28, 1981

[54] AFTER TREATMENT OF CELLULOSIC TEXTILES DYED WITH FIBER-REACTIVE DYES

[75] Inventors: Jean-Pierre Chavannes, Attenschwiller; René Fischer, Baldersheim, both of France; Saverio Fornelli, Basel, Switzerland; Francis Palacin, Riedisheim, France

[73] Assignee: Sandoz Ltd., Basel, Switzerland

[21] Appl. No.: 54,624

[22] Filed: Jul. 3, 1979

[30] Foreign Application Priority Data

Jul. 7, 1978 [CH] Switzerland ..... 7418/78

[51] Int. Cl.[3] ..... D06P 3/34; D06P 5/02

[52] U.S. Cl. ..... 8/543; 8/557

[58] Field of Search ..... 8/54.2, 74, 73, 543, 8/557

[56] References Cited

U.S. PATENT DOCUMENTS

| | | | |
|---|---|---|---|
| 2,094,809 | 10/1937 | Olpin et al. | 8/73 |
| 4,036,587 | 7/1977 | Wolf et al. | 8/92 |
| 4,060,387 | 11/1977 | Baumann et al. | 8/74 |

FOREIGN PATENT DOCUMENTS 899798 1/1961 United Kingdom .

*Primary Examiner*—William F. Hamrock

*Attorney, Agent, or Firm*—Gerald D. Sharkin; Richard E. Vila; Thomas C. Doyle

[57] ABSTRACT

A process for dyeing or printing with a fibre-reactive dyestuff a substrate consisting of or comprising cellulosic fibres, which process comprises treating the dyed or printed substrate, at a temperature from 20° to 105° C. with an aqueous solution of a polymer containing carboxylic acid groups at least partially neutralized in salt form.

19 Claims, No Drawings

AFTER TREATMENT OF CELLULOSIC TEXTILES DYED WITH FIBER-REACTIVE DYES

The present invention relates to a process for dyeing or printing a substrate consisting of or comprising cellulosic fibres with fibre-reactive dyestuffs.

In general it is necessary to submit a cellulosic substrate which has been dyed or printed with a fibre-reactive dyestuff to a washing treatment subsequent to the fixation and rinsing steps in order to remove they hydrolysed and unfixed reactive dyestuff and thereby to improve the fastness of the dyeings and printings, particularly the wet and rubbing fastnesses. However, the inorganic or organic detergents which are usually employed in the washing step are neither able to prevent a re-exhaustion of the unfixed and hydrolysed reactive dyestuff onto the substrate, nor efficient enough to wash all of it off. Moreover, most of these detergents give rinse to an excessive and undesired foaming, and washing agents based on phosphates have become more and more unacceptable for ecological reasons.

The present invention provides a process for dyeing or printing with a fibre-reactive dyestuff a substrate consisting of or comprising cellulosic fibres, which process comprises treating the dyed or printed substrate, at a temperature from 20° to 105° C. with an aqueous solution of a polymer containing carboxylic acid groups at least partially neutralized in salt form.

Suitable polymers according to the invention are polycarboxylic acids containing carboxylic acid groups in free form and/or in the salt form, with a molecular weight from 500 to 5,000,000, preferably from 1,000 to 1,000,000, more preferably from 1,000 to 500,000. They may be linear and/or crosslinked and may contain, in addition to the carboxylic acid groups, further frictional groups, preferably such which are derived from the carboxylic acid function.

Examples of suitable polycarboxylic acids include homopolymers of acrylic acid, methacrylic acid, α-hydroxy-acrylic acid, crotonic acid or iso-crotonic acid, and copolymers of acrylic acid, methacrylic acid or maleic anhydride with one or more further ethylenically unsaturated compounds. The copolymers of acrylic acid or methacrylic acid with ethylenically unsaturated comonomers may contain up to 80% by weight of the latter monomers, preferably from 1 to 20% by weight. As examples of ethylenically unsaturated monomers, copolymerizable with acrylic or methacrylic acid, may be given ethylene, propylene, isobutylene, butadiene, alkyl($C_1$–$C_4$) or hydroxyalkyl($C_1$–$C_4$)acrylate, alkyl($C_1$–$C_4$) or hydroxyalkyl($C_1$–$C_4$)methacrylate, alkyl($C_1$–$C_4$)α-hydroxy-acrylate, acrylamide, methacrylamide, acrylonitrile, methacrylonitrile, divinyldioxane, divinylbenzene, vinyl ethers, vinyl esters of ($C_1$–$C_5$)carboxylic acids, etc. Preferred copolymers are those obtained by copolymerization of acrylic acid or methacrylic acid with one of the olefinic monomers stated above. Copolymers of acrylic acid with methacrylic acid may also be used.

Copolymers of maleic anhydride which may be used according to the invention are those obtained by copolymerization of maleic anhydride with an ethylenically unsaturated monomer such as ethylene, propylene, isobutylene, vinyl esters of ($C_1$–$C_5$)carboxylic acids, e.g. vinyl acetate or propionate, vinyl ethers, e.g. alkyl ($C_1$–$C_4$)vinyl ethers such as methylvinyl ether, or styrene. Preferred copolymers of maleic anhydride contain the maleic anhydride and the other copolymerizable monomer in a substantially equimolar proportion.

The most preferred polymers according to the process of the invention are polyacrylic acid, poly-α-hydroxyacrylic acid, ethylene/maleic anhydride copolymer and methylvinyl ether/maleic anhydride copolymer.

As will be appreciated, the copolymers of maleic anhydride must be at least partially hydrolysed to yield carboxylic acid groups which may be further at least partially transformed into the salt form.

According to the invention, the polycarboxylic acid is used in an at least partially neutralized form, i.e. in the form of a polymer in which from one to the whole number of carboxylic acid groups are in salt form. Preferably, all the carboxylic groups present in the polymer are in salt form. However, when a polymer with a high molecular weight, e.g. above 1,000,000, particularly a cross-linked polymer, is used at the highest concentration rate as indicated, full neutralization of this polymer may not be appropriate since it could increase the viscosity of the aqueous solution containing such polymer and such an increase of the solution viscosity may be undesirable for technical reasons. Preferably, the process is carried out with a water-thin solution of the polymer.

Suitable polymer salts are obtained by partial or full neutralization of the polycarboxylic acid with a basic compound, e.g. an inorganic base such as ammonia or an alkali metal hydroxide, e.g. sodium, potassium or lithium hydroxide, an organic base such as an amine, e.g. methylamine, triethylamine or triethanolamine, or an alkali salt such as sodium or potassium carbonate. The polycarboxylic acids are preferably used in sodium salt form, i.e. at least one of the carboxylic acid groups is in sodium salt form, more preferably all the carboxylic acid groups are in sodium salt form.

The amount of polymer to be used depends on various factors, particularly on the liquor to goods ratio. In general, satisfactory results are obtained when there is used an aqueous solution containing, per liter, from 0.1 to 10 g, preferably from 1 to 5 g of polymer, the liquor to goods ratio being from 3:1 to 40:1, preferably from 5:1 to 20:1. Depending on the degree of neutralization of the polymer and the concentration of the polymer, the pH of the aqueous solution may be from 5 to 12, preferably from 6 to 8.

The cellulosic substrate is dyed or printed with a cold-dyeing or hot-dyeing fibre-reactive dyestuff in accordance with known methods. Preferably the dyeing is effected according to known exhaustion methods, particularly with a fibre-reactive dyestuff having a high degree of substantivity towards the substrate. Fixation of the dyeings or printings is effected in known manner. After rinsing, the dyed or printed substrate is treated with an aqueous solution of a polymer as stated above for 5 to 60 minutes, preferably 5 to 30 min., this treatment being preferably carried out at a temperature from 50° to 105° C. During the treatment with the polymer, agitation of the substrate and/or of the bath is necessary; therefore, it is appropriate to carry out the treatment in a conventional washing machine or, preferably, in the same machine as used for the dyeing. Subsequently, the substrate is submitted to further rinsing and dried in accordance with known methods.

The process of the invention is suitable for dyeing or printing cellulosic fibres, e.g. natural or regenerated cellulose, particularly cotton, blends thereof or blends with synthetic fibrous materials. The textile substrates may be in any conventional form, e.g. fibres, threads, filaments, knitted, woven and finished goods.

The dyeings and printings obtained according to the invention exhibit notable wet-fastness, e.g. wash, water, sea water and perspiration fastness. In the process, the unfixed and hydrolysed fibre-reactive dyestuff is washed off and does not re-exhaust on the substrate. The process is particularly advantageous for printing on a white ground, the staining of the background being prevented. Futhermore, no significant foaming appears during the treatment with the polymer and therefore the process may be effected in machines operating with a short bath ratio.

The following Examples further serve to illustrate the invention. In the Examples the percentages are by weight and the temperatures are in degrees centigrade.

EXAMPLE 1

A knitted cotton substrate is dyed in a liquor ratio of 20:1 with 4 g/l of C.I. Reactive Red 86 according to the "all-in" dyeing process. Directly after the dyeing, the substrate is rinsed, first at 60° then cold, and subsequently washed at boiling temperature with an aqueous solution containing 1 g/liter of a hydrolysed copolymer of maleic anhydride and ethylene in a substantially 50:50: molar ratio; this copolymer has a molecular weight of 15,000 and the aqueous solution thereof has been previously neutralized to pH 7 with caustic soda. Subsequently to the washing, the substrate is rinsed at 60°, then cold rinsed and finally dried.

The substrate is treated with each bath for 10 minutes, at a liquor to goods ratio of 20:1.

A deep red dyeing is obtained with good water fastness.

EXAMPLE 2

By following the procedure of Example 1, but using an aqueous solution containing 1 g/liter of a hydrolysed and fully neutralized ethylene/maleic anhydride copolymer (50:50 molar ratio) having a molecular weight of 5,000, similar good results are obtained.

EXAMPLE 3

A knitted cotton substrate is dyed in a liquor ratior of 5:1 with 16 g/l of C.I. Reactive Blue 79 according to the "all-in" dyeing process. Directly after the dyeing, the substrate is rinsed, first at 60° then cold, and subsequently washed at boiling temperature with an aqueous solution containing 1 g/liter of polyacrylic acid sodium salt having a molecular weight of 500,000. Subsequently, the substrate is rinsed at 60° then cold rinsed and dried.

The substrate is treated with each bath for 10 minutes, at a liquor to goods ratio of 5:1.

A dark navy blue dyeing is obtained with good wet fastness.

EXAMPLE 4

By following the procedure of Example 3 but using, instead of the polyacrylic acid sodium salt, 1 g/liter of poly-α-hydroxy-acrylic acid sodium salt with a molecular weigh of 5,000, equally good results are obtained.

EXAMPLE 5

A cotton substrate is dyed in a liquor ratio of 5:1 with 5 g/l of C.I. Reactive Orange 11, 5 g/l of C.I. Reactive Red 55 and 5 g/l of C.I. Reactive Blue 79, according to the known methods. The substrate is submitted directly after the dyeing to the following treatment:

The dyed substrate is rinsed first at 60° then cold and subsequently washed at boiling temperature with an aqueous solution containing 1 g/liter of a hydrolysed copolymer of maleic anhydride and ethylene (50:50 molar ratio) having a molecular weight of 15,000. The aqueous solution of the copolymer has been previously neutralized to pH 7 with a concentrated solution of sodium hydroxide. Subsequently to the washing, the substrate is rinsed at 60°, then cold rinsed and dried.

The substrate is treated with each bath for 10 minutes, at a liquor to goods ratio of 5:1.

A dark brown dyeing is obtained with good wet fastness.

EXAMPLE 6

A white mercerised cotton satin is printed with a paste containing 30 g/kg of C.I. Reactive Blue 18. After the printing has been fixed according to known methods, the substrate is cold rinsed for 5 minutes and then washed at boiling temperature for 10 minutes with an aqueous solution containing 1 g/l a hydrolysed ethylene/maleic anhydride copolymer (50:50 molar ratio) having a molecular weight of 2,000. Before use this aqueous solution has been neutralized with sodium hydroxide to pH 7. Subsequently, the treated substrate is cold rinsed for 3 minutes. The liquor to goods ratio is 40:1 in each rinsing and washing bath.

There is obtained a turquoise printing on a white unstained ground, with good wet fastness.

In analogous manner to the procedures described in Examples 1 to 6 above a hydrolysed and fully neutralized methyl vinyl ether/maleic anhydride copolymer (50:50 molar ratio; molecular weight of 10,000) is employed.

What we claim is:

1. In a process wherein a substrate comprising cellulosic fibers is dyed or printed with a fiber-reactive dyestuff and, subsequent to the dye fixation and rinsing, is submitted to a washing treatment to remove hydrolyzed and unfixed dyestuff, the improvement which comprises effecting the washing treatment at a temperature of 20° to 105° C. in an aqueous solution of an effective amount of a polymer containing carboxylic acid groups at least partially neutralized in salt form.

2. A process according to claim 1, in which the polymer containing carboxylic acid groups at least partially neutralized in salt form has a molecular weight from 500 to 5,000,000.

3. A process according to claim 1 in which the polymer is polyacrylic acid, polymethacrylic acid, poly-α-hydroxy-acrylic acid, poly-crotonic acid or poly-isocrotonic acid.

4. A process according to claim 1 in which the polymer is a copolymer of acrylic acid or methacrylic acid with up to 80% by weight of one or more ethylenically unsaturated comonomers.

5. A process according to claim 1, in which the polymer is a copolymer in a substantially equimolar proportion of maleic anhydride with an ethylenically unsaturated comonomer, the copolymer having been at least partially hydrolysed.

6. A process according to claim 1, in which the carboxylic acid groups present in salt form in the polymer are in form of sodium, potassium, lithium, ammonium or an amine salt.

7. A process according to claim 1, in which all the carboxylic acid groups present in the polymer are in salt form.

8. A process according to claim 1, in which the ratio of the polymer-containing liquor to goods is from 3:1 to 40:1.

9. A processaccording to claim 1, in which the aqueous solution contains, per liter, from 0.1 to 10 g of the polymer.

10. A process according to claim 1, in which the dyed or printed substrate is rinsed after the treatment with the polymer.

11. Dyed or printed textiles whenever obtained by a process according to claim 1.

12. A process according to claim 1 wherein the washing treatment is effected with agitation of the substrate and/or the treatment bath.

13. A process according to claim 12 wherein the washing treatment is carried out for 5 to 30 minutes at a temperature of 50° to 105° C.

14. A process according to claim 1 wherein the polymer is polyacrylic acid at least partially neutralized in sodium salt form.

15. A process according to claim 2 wherein the polymer has a molecular weight of 1,000 to 1,000,000.

16. A process according to claim 4 wherein the ethylenically unsaturated comonomer is ethylene, propylene, isobutylene, butadiene, alkyl($C_{1-4}$)acrylate, hydroxyalkyl-($C_{1-4}$) acrylate, alkyl($C_{1-4}$)methacrylate, hydroxyalky($C_{1-4}$)methacrylate, alkyl($C_{1-4}$)α-hydroxy acrylate, acrylamide, methacrylamide, acrylonitrile, methacrylonitrile, divinyldioxane, divinylbenzene, a vinyl ether or a vinyl ester of a ($C_{1-5}$)carboxylic acid.

17. A process according to claim 5 wherein the comonomer is ethylene, propylene, isobutylene, a vinyl ester of a ($C_{1-5}$)carboxylic acid or an alkyl($C_{1-4}$) vinyl ether.

18. A process according to claim 1 wherein the polymer containing carboxylic acid groups is polyacrylic acid, poly-α-hydroxyacrylic acid, ethylene-maleic anhydride copolymer or methylvinyl ether-maleic anhydride copolymer.

19. A process according to claim 12 wherein the polymer containing carboxylic acid groups has a molecular weight of 1,000 to 1,000,000 and is a homopolymer of acrylic acid, methacrylic acid, α-hydroxy-acrylic acid, crotonic acid or iso-crotonic acid; a copolymer of acrylic or methacrylic acid with up to 80% by weight of ethylene, propylene, isobutylene, butadiene, alkyl($C_{1-4}$)acrylate, hydroxyalkyl($C_{1-4}$)acrylate, alkyl($C_{1-4}$)methacrylate, hydroxyalkyl($C_{1-4}$)methacrylatel, alkyl($C_{1-4}$) α-hydroxy-acrylate, acrylamide, methacrylamide, acrylonitrile, methacrylonitrile, divinyldioxane, divinylbenzene, a vinyl ether or a vinyl ester of a ($C_{1-5}$)carboxylic acid; or a copolymer of maleic anhydride with ethylene, propylene, isobutylene, a vinyl ester of a ($C_{1-5}$)carboxylic acid or an alkyl($C_{1-4}$)vinyl ether, and the carboxylic acid groups in salt form are in the form of sodium, potassium, lithium, ammonium or amine salts and the solution contains 0.1 to 10 g/l of the polymer and is present in a liquor-to-goods ratio of 3:1 to 40:1 and the substrate is rinsed after treatment with the polymer.

* * * * *